United States Patent [19]

Hara et al.

[11] 3,956,101

[45] May 11, 1976

[54] PRODUCTION OF COKES

[75] Inventors: Naoyoshi Hara; Akihiro Fujimori, both of Yokohama; Hideo Hashimoto, Sagamihara; Takuji Hosoi, Tokyo; Takaaki Aiba, Yokohama; Tsuneo Okamoto, Kawaguchi, all of Japan

[73] Assignees: Kureha Kagaku Kogyo Kabushiki Kaisha, Tokyo; Chiyoda Kako Kensetsu Kabushiki Kaisha, both of Japan

[22] Filed: Jan. 14, 1974

[21] Appl. No.: 432,888

Related U.S. Application Data

[63] Continuation-in-part of Ser. No. 187,517, Oct. 7, 1971, abandoned.

[30] Foreign Application Priority Data

Oct. 9, 1970 Japan ..... 45-88228

[52] U.S. Cl. ..... 208/50; 208/46; 208/128; 208/130

[51] Int. Cl.[2] ..... C10G 9/36; C10G 37/02

[58] Field of Search ..... 208/46, 106, 125, 127, 208/128, 129, 130, 50, 131

[56] References Cited

UNITED STATES PATENTS

| | | | |
|---|---|---|---|
| 2,366,055 | 12/1944 | Rollman | 208/131 |
| 2,873,244 | 2/1959 | Hemminger | 208/50 |
| 2,922,755 | 1/1960 | Hackley | 208/50 |
| 2,985,585 | 5/1961 | Scott | 208/127 |
| 3,654,134 | 4/1972 | Wirth et al. | 208/127 |

*Primary Examiner*—Herbert Levine
*Attorney, Agent, or Firm*—Wenderoth, Lind & Ponack

[57] ABSTRACT

High grade cokes are produced by a simple expedient such that a raw material oil is charged into a coking drum and is subjected therein to a two step operation, namely reforming of the oil and subsequent coking under bubbling into the oil of a heated non-oxidizing gas. No fluidized bed of the oil to be coked is formed.

8 Claims, 1 Drawing Figure

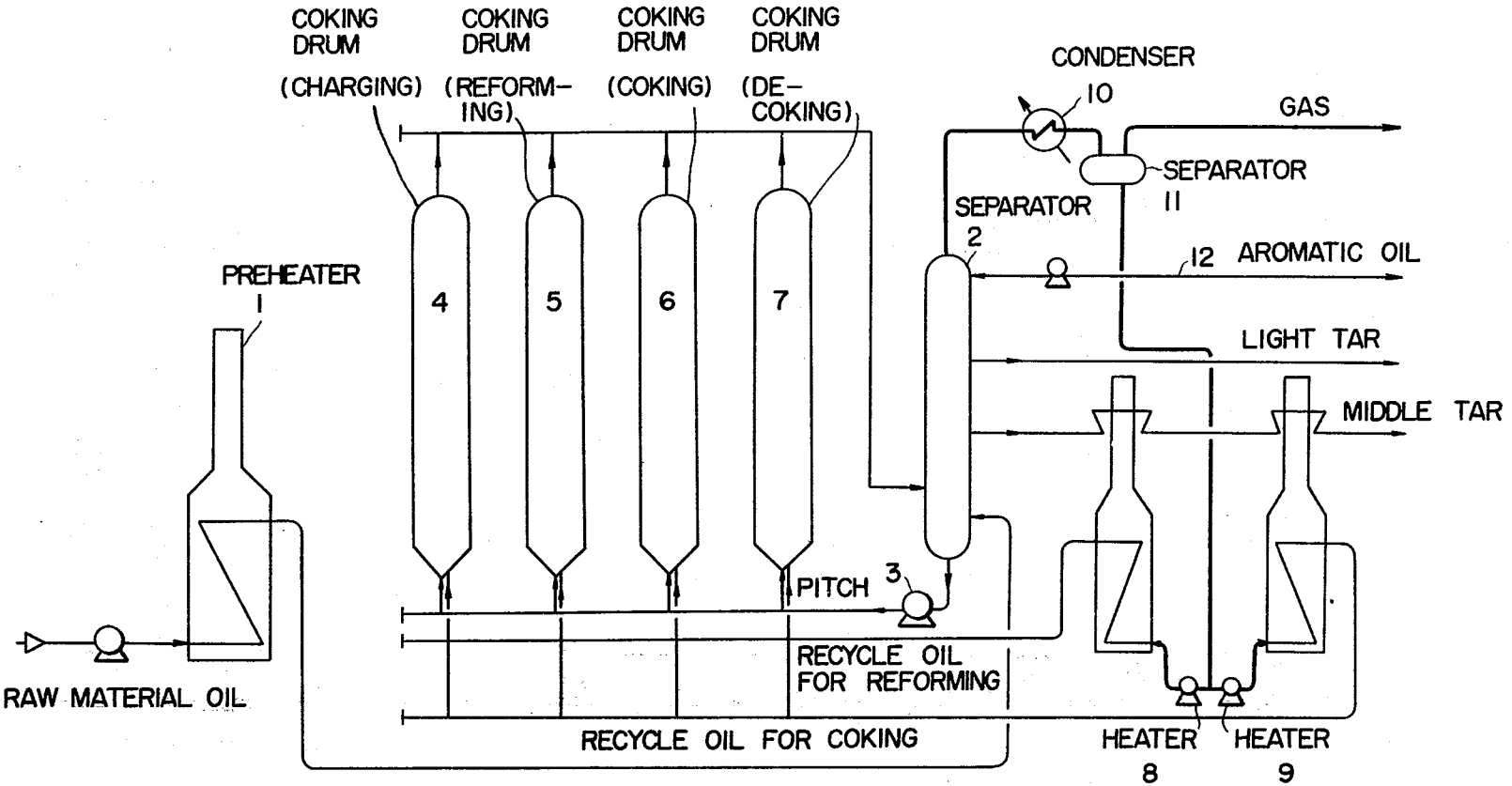
GAS
CONDENSER
10
SEPARATOR
11
SEPARATOR
2
12 AROMATIC OIL
LIGHT TAR
MIDDLE TAR
HEATER
9
HEATER
8
3
PITCH
RECYCLE OIL FOR REFORMING
RECYCLE OIL FOR COKING
COKING DRUM (DE-COKING)
7
COKING DRUM (COKING)
6
COKING DRUM (REFORM-ING)
5
COKING DRUM (CHARGING)
4
PREHEATER
1
RAW MATERIAL OIL

PRODUCTION OF COKES

CROSS-REFERENCE TO RELATED APPLICATION

This is a continuation-in-part application of our application Ser. No. 187,517 filed Oct. 7, 1971, now abandoned.

BACKGROUND OF THE INVENTION a. Field of Invention

This invention relates to production of high grade cokes for use in graphite electrodes, etc.. More particularly, it is concerned with a simple, but very effective method for obtaining cokes from hydrocarbon compounds having large molecular weight or mixture of hydrocarbon compounds containing such large molecular weight hydrocarbons such as crude petroleum oil, distilled residue oils, ethylene cracker bottom oil, various pyrolytic tars and pitches, coal tar, coal pitch, and so on.

b. Discussion of Prior Art

Heretofore, many a method has been proposed as to production of cokes, among which "delayed coking method," "fluid coking method," and "oven method" are still existing and operating on an industrialized scale. However, in these existing coking methods, there are various problems still to be solved to eliminate disadvantages inherent thereto.

For example, in the delayed coking method, raw material oil is heated to a coking temperature through a tubular heating furnace, after which it is sent into a coking drum. An important problem in this case is how to prevent the tubular heating furnace from being clogged due to the coking. Various efforts have been exerted to solve this problem by stringent control of the heating temperature, pressure, and flow rate of the raw material through the tubular furnace, etc., or, in many cases by adding steam or other fluid medium to the raw material within the tubular heating furnace. However, these operations are not only not directed to improvement in quality of the produced cokes, but also result in sacrificing the optimum treating conditions for the grade of cokes. With increased demand for HP or UHP electrodes for metallurgy and so forth in recent years, production of high grade, needle-shaped cokes has been desired more and more. On the other hand, from the aspect of the raw material for cokes, there has been a tendency such that a larger quantity of various pyrolytic tars and oils is being produced as by-product in petrochemical industries. Although these materials are generally suitable as the raw material for needle-shaped cokes in view of their composition and molecular structure, they tend to be thermally unstable, which brings about various difficulties in the heating operation with the delayed coking method, in which the tubular heating furnace is used.

Also, in the oven method where the raw material oil is heated through a partition wall, it may be possible to control the relationship between the heating temperature and time. In this case, however, as the heat transfer speed is remarkably low, the structure of the furnace, reaction temperature, and other conditions are considerably restricted. Furthermore, the raw material oil in the oven cannot be maintained at a uniform temperature throughout, because agitating power, due to convection of heat, as well as gas spontaneously generated within the furnace, is too slight to produce the required agitation. Moreover, there is no way of expelling heat from the furnace, wherein an exothermic reaction raises the temperature of the furnace interior. After all, it is not easy to obtain homogeneous, high grade cokes even by this method.

SUMMARY OF THE INVENTION

It is therefore the primary object of the present invention to provide a improved method of producing cokes, in which the optimum conditions for the coking reaction suited for various raw material oils are established.

It is another object of the present invention to provide an improved method for producing cokes by blowing a non-oxidizing gas into the raw material oil charged in a coking drum.

It is still aother object of the present invention to provide a method for producing cokes, in which the raw material oil is heat-treated or reformed prior to the coking operation.

It is a further object of the present invention to provide a method for producing cokes comprising two steps, namely reforming of a raw material oil and coking of the thus reformed oil in a single coking drum under introduction of a non-oxidizing gas as a heating medium and as an agitating medium for the oil to be coked. The two step operation in a single coking drum under introduction of a heating gas is distinct from the conventional operation of the delayed coking method.

The foregoing objects as well as the details of the present invention will become more apparent from the following description when read in connection with the drawing and the preferred embodiments thereof.

BRIEF DESCRIPTION OF THE DRAWING

The drawing is a schematic diagram showing one embodiment of the process of the present invention wherein four coking drums are utilized so that a continuous coking operation, which is otherwise per se batchwise in nature, is realized.

DETAILED DESCRIPTION OF THE INVENTION

According to the flow diagram in the drawing, a raw material oil is first pre-heated in a preheater 1 to a temperature of 200° to 300°C, and is then charged to the bottom of a separator 2 wherein the oil is fractionated into a heavy oil fraction, a middle tar fraction, a light tar fraction and a gaseous fraction. The composition of the heavy oil fraction can be modified by introduction of a aromatic oil to the separator 2 via line 12. The heavy oil fraction thus fractionated is then charged by means of a pump 3 to a coking drum 4 which is one of coking drums 4 to 7.

To the bottom of the coking drum 4 charged with the heavy oil fraction, a non-oxidizing gas, e.g., vapor of a light hydrocarbon oil, which has been super heated in a heater 8, is blown so as to heat the heavy oil, as a liquid pool in the coking drum whereby reforming of the heavy oil is effected. The reforming of the heavy oil is effected at a temperature of 300° to 400°C, under a pressure of 2 mm Hg to 3 atmospheric pressures for 0.5 to 10 hours, preferably for 2 to 7 hours. Regulation or control of the temperature and/or flow rate of the gas may be necessary so as to maintain the reforming conditions. As the vapor of a light hydrocarbon oil, use may be made of the gaseous fraction produced overhead of the separator 2 possibly after being condensed at a condenser 10 and separated at a separator 11 from the non-condensed gas fraction.

Thereafter, the coking step is initiated in the very same coking drum 4 by heating the liquid pool reformed heavy oil fraction at a coking temperature which is higher than the reforming temperature under a super atmospheric pressure. Thus, the temperature of the reformed heavy oil fraction is elevated to a coking temperature of 400° to 500°C by switching off the introduction of the heating gas followed by bubbling through the liquid pool a hotter heating gas, which is here again a non-oxidizing gas, e.g., vapor of a light hydrocarbon oil which may be produced overhead of the separator 2, which has been super heated in a heater 9, and heating at this temperature is continued until coking of the reformed heavy oil fraction has substantially been completed. Flow rate of the gas for coking must be controlled so that the linear velocity of the gas be 5 to 50 millimeters/second in terms of a linear velocity through an empty coking drum 4. Such a relatively low flow rate may not cause the charge in the drum under coking to form a fluidized bed in the coking drum. The temperature of the heating gas is preferably higher than the coking temperature by at most 300°C, more preferably by at most 100°C, and at the later stage of coking the temperature of the gas can be lower than the coking temperature so as to compensate the exothermic heat of coking.

Upon completion of the coking, introduction of the heating gas is terminated and the drum is allowed or forced to cool. Decoking is then effected.

A cycle of unit steps of charging of a heavy oil fraction-reforming-coking-decoking takes place in the single coking drum 4. The same cycle can be effected in the coking drums 5 to 7 in parallel with the coking drum 4. When the cycles of coking drums are effected with proper time lags among the coking drums 4 to 7, continuous production of coke is realized. For instance, upon completion of reforming in the coking drum 4, the heating gas supplied from the heater 8 is switched to the coking drum 5 while the coking drum 4 is operated with introduction of the hotter heating gas supplied from the heater 9 to undergo coking therein, and upon completion of coking in the coking drum 4 the heating gas is switched to the coking drum 5 to effect coking in the coking drum 5. The heating gas initially supplied to the coking drum 5 to effect the reforming therein is then switched to the coking drum 6, and the coking drums 6 and 7 are operated in a similar way. The drawing shows that at a given time of operation the coking drums 4, 5, 6, and 7 are at charging step, reforming step, coking step, and decoking step, respectively. In such a continuous way of operation, at least two and preferably three to five coking drums are necessary.

In the production of cokes, grade of the raw material occupies the largest part of the factors to determine the grade of the resulting cokes. It is therefore recommended that the raw material be pretreated for improving the quality thereof.

In general, when hydrocarbon compounds having large molecular weight, or mixture of hydrocarbon compounds containing such large molecular weight hydrocarbons such as crude petroleum oil, its distilled residue, ethylene cracker bottom oil, various pyrolytic tars, coal tar, coal pitch, etc., are heated, they are decomposed, polycondensed, and finally carbonized. This is considered to be the coking reaction, which proceeds quicker as the reaction temperature increases. Further, the coking reaction is considered to be a kind of crystal growth. The reaction condition under which large crystals are produced would result in the cokes of higher grade.

The raw material to be used in the present invention may be any one of the following:

1. residual oil resulting from distillation or solvent extraction of petroleum to separate light fractions therefrom;
2. heavy tars or pitches resulting from pyrolysis of various petroleum oils, which may be subjected to heat-treatment for improving the quality thereof (reforming);
3. heavy distilled fractions such as coal tar or coal pitch; and
4. mixtures of the abovementioned substances which melt at a temperature below a range of 250° to 450°C to assume a liquid state.

The material selected from the above group is, after being preheated, charged to a coking drum, and subjected therein to a heat treatment or more precisely reforming at a temperature at which decomposition and polycondensation of the substances begin to take place, or at a temperature slightly lower than such decomposing and polycondensing temperature, or, more concretely, at a temperature of from 300° to 400°C under a pressure of from 2 mm Hg to 3 atm. or so for a time period of from 0.5 to 10 hours, or more preferably, about 2 to 7 hours, preferably under introduction therein of a non-oxidizing gas.

The important thing to remember in this heat treatment is that the specific temperature at which the decomposition and polycondensation of the raw material begins to take place varies depending on the raw material used.

Generally speaking, at this stage of the process, the least amount of gas is generated during the heat-treatment after the heating temperature reaches its required level. Oil component may also exude, but its quantity is from 1 to 5% by weight at the most.

The following Table 1 shows the results of various measurements of (a) tarry substance obtained by pyrolysis of ethylene cracker bottom oil at a temperature of 1,100°C for a time instant of 2/1,000 second, and (b) pitches obtained by heat-treating the abovementioned tarry substance at 350°C under 1.8 atmospheres for 5 hours, and then reducing the pressure at a temperature of less than 300°C to remove the fractions of 450°C and below, converted in terms of the atmospheric pressure.

Table 1

| Sample | Heat-treatment | R | H/C | Mean Molecular Weight | Insoluble Component in Solvent n-heptane (wt. %) | Insoluble Component in Solvent chloroform (wt. %) | Yield of Cokes (%) |
|---|---|---|---|---|---|---|---|
| (a) | — | 1.86 | 0.64 | 495 | 91 | 1 | 34.7 – 36.1 |

Table 1-continued

| Sample | Heat-treatment | R | H/C | Mean Molecular Weight | Insoluble Component in Solvent n-heptane (wt. %) | Insoluble Component in Solvent chloroform (wt. %) | Yield of Cokes (%) |
|---|---|---|---|---|---|---|---|
| (b) | treated | 1.71 | 0.58 | 570 | 90 | 4 | 40.0 – 48.3 |

NOTE:

1. R = Ratio of hydrogen in the aliphatic side chain attached to the aromatic ring with respect to hydrogen existing in the aromatic ring. Measurement is done by the NMR spectrum.
2. H/C = Ratio of hydrogen and carbon due to the elemental analyses.
3. Coking is done at a temperature of 430°C under normal pressure for 20 hours.

As is understood from Table 1, the heat-treatment causes polymerization and other reactions in the raw material, as a result of which the mean molecular weight of the raw material increases, and aliphatic hydrocarbon 5, containing therein much hydrogen of the aliphatic side chain attached to the aromatic ring, are removed. Another thing of importance to note is that the rate of yield of cokes is increased by about 10 to 30% after the heat-treatment for 5 hours. This phenomenon indicates that even the light fractions which are volatilized as vapour at the time of the coking reaction turn into heavy fractions of high boiling point which are possibly coked.

In addition, the cokes produced from the raw material which has been pretreated in the above manner are found to be more excellent than that obtained from the non-pretreated raw material in their bulk density, true specific gravity, external appearance of needle-shaped crystals, and thermal expansion coefficient.

It should be particularly noted that, in this heat treatment or reforming, there appears to take place not only the decomposition and polycondensation of the raw material which is considered to be a simple coking reaction, but also other complicated reactions such as a kind of dissociation and association, increase in aromaticity of the raw material hydrocarbon due to removal of aliphatic hydrocarbon, change in molecular orientation, and so on. By this dissociation and association, the aliphatic hydrocarbons existing in the pitch molecules are removed.

When the coking reaction is carried out with such aliphatic hydrocarbon component being present in the raw material, a three dimensional structure tends to be formed due to cross-linking action by such aliphatic chains, which obstructs the crystal growth in the resulting cokes. However, once the aliphatic component is perfectly removed, there readily takes place the desired crystal growth due to the polycondensation of the aromatic components with the consequence that cokes of excellent graphitizing property are obtained.

The raw material thus reformed is then subjected to coking in the very same coking drum (or a coker) at a coking temperature, during which a non-oxidizing gas heated to a temperature higher than the temperature of the raw material is blown into the coking drum from the bottom or lower part of the drum. The temperature difference between the gas and the raw material is within 300°C, or, preferably not higher than 100°C.

The gas to be used for this purpose may desirably be vapor of any light hydrocarbon oil. In some cases, it is possible to use a gas such as hydrogen, nitrogen, steam, etc., which is non-oxidizing at a temperature region where the process of this invention applies.

The gas is blown into the coking drum through a single or a plurality of nozzles from the bottom or a lower part thereof, or any other position where the liquid raw material within the coking drum can be effectively agitated. Upon blowing into the coking drum of the heating gas, the raw material gradually increases its temperature to reach its coking level.

The coking temperature differs to some extent depending on the raw material. It is generally in the range of from 400° to 500°C or so.

As the coking temperature is being reached, the temperature difference between the raw material and the blowing gas becomes small. When the coking temperature is reached, the heating of the raw material stops. In order, however, to maintain the uniform coking temperature to the end, blowing of the gas is further continued. The gas blowing operation plays a principal role of agitating the raw material within the coking drum, which helps proceed the coking reaction of entire raw material.

As the coking reaction proceeds, the raw material gradually increases its viscosity to become solidified. In the course of the reaction, generation of heat from the reaction system may take place. When the reaction proceeds vigorously, a large amount of heat is generated, so that, if no appropriate measure is taken to remove such large amount of heat, the temperature within the coking drum increases to a prohibitive level, and heat accumulated therein will make it extremely difficult to control the reaction temperature. Blowing of the gas current into the coking drum in the present invention serves to remove heat generated during the coking reaction. That is, by appropriately controlling quantity and temperature of the blowing gas, the entire raw material can be maintained at a uniform temperature region. In the production of high grade cokes such as needle-shaped cokes, it is necessary that the molecular structure having the arrangement and orientation of carbon as in the graphite crystal be grown sufficiently large, for the purpose of which the reaction of the entire raw material needs to proceed uniformly. In addition, in the course of solidification, an operation of moving the liquid raw material by imparting thereto any kind of force in one direction would function very effectively. The blowing of the gas current, when it is carried out under appropriate conditions, can satisfy the dual effects of the temperature control and the crystal orientation. The optimum condition for blowing of the gas current depends on the coking temperature, pressure, kind of the raw material, and other factors. If the flow rate of the gas is indicated in terms of the flowing speed of the gas through an empty drum, it is in the range of from 5 to 50 millimeters/second. The range of the linear velocity, 5 to 50 millimeters/second, has been selected and limited so that the following features be realized:

a. Effects and advantages due to the gas injection can be realized.
b. Heat balance of the coking reaction can be maintained.
c. Variations in the coking reaction conditions can be covered by this range. The proper choice of pressure, which is one of the coking reaction conditions, substantially depends on the particular gas flow rate selected.

The coking reaction is completed after following the above-mentioned process steps, although the gas is continuously blown to the end. If necessary, the coking reaction can be finished in a shorter time by further increasing the flow rate of the gas current to raise the heating temperature at the latter part of the coking reaction, after the major stage of controlling the grade of the produced cokes has been completed.

The advantage of the present invention over the above-mentioned known method is that the heating of the raw material is carried out in the coking drum, which not only avoids clogging of the coking apparatus, but also permits establishment of optimum conditions for improved quality of the produced cokes, particularly the coking temperature range and relationship between the heating speed and heating time, which conditions cannot be realized by the known method such as "delayed coking method." These conditions are indispensable in manufacturing needle-shaped cokes of good quality.

As stated in the foregoing, the coking method according to the present invention readily solves the difficult problems in the course of heating the raw material by a very simple operation of gas blowing. Furthermore, by controlling the flow rate of the blowing gas current along with the coking temperature and pressure, it is possible to obtain cokes of excellent quality, while maintaining the optimum conditions for every kind of the raw materials throughout the coking operation.

DESCRIPTION OF PREFERRED EMBODIMENTS

In order to further enable those skilled in the art to reduce this invention into practice, the following preferred examples are presented. It should however be noted that the invention is not limited to these examples alone, but any changes and modifications may be possible within the scope of protection sought as recited in the appended claims.

EXAMPLE 1

A tarry material which was produced as by-product at the time of producing ethylene, etc., by the naphtha cracking and which composition was as shown in the following Table 2 was subjected to flash-distillation at 350°C under a pressure of 2.5 atm., whereby it was divided into two distilled fractions of light and heavy fractions. These two distilled fractions were found to have the distilled composition as shown in Table 3 below.

Table 2

| Distilled Composition of Crude Tar | |
|---|---|
| Below 250°C | 38 wt % |
| 250°C - 350°C | 31 " |
| 350°C - 450°C | 14 " |
| Above 450°C | 17 " |

Table 3

| Distillate | Distilled Composition of Flash-Distillate Light Fraction | | Heavy Fraction | |
|---|---|---|---|---|
| Below 250°C | 67 | wt % | 0 | wt % |
| 250°C - 450°C | 27 | " | 36 | " |
| 350°C - 450°C | 6 | " | 25 | " |
| Above 450°C | 0 | " | 39 | " |
| Distillation Yield | 56.4 | % | 43.6 | % |
| Mean Molecular weight | 180 | | — | |

120 kg of the heavy fractions shown in Table 3 above was charged into a coking drum of a size of 30 cm in inner diameter and 2.8 m in height, and was heat-treated by means of an external heating type electric heater for 8 hours at a temperature of 350°C under a pressure of 1.8 atmospheres.

The material thus pretreated was subjected to coking in the same coking drum by blowing thereinto the light fraction of hydrocarbon material having an average boiling point of 160°C as shown in Table 3 in the form of a gas heated to a temperature range of 420° to 500°C through a nozzle of 6 mm in inner diameter provided at the bottom center part of the coking drum at an average flow rate of 45 kg/hour. The calculated linear velocity of the gas was 15 mm./sec.. The light fractions of the hydrocarbon used for the coking was circulated for repeated use through a separation tower provided at the gas outlet on top of the coking drum.

The coking operation was conducted under such conditions that the raw material was first heated for 12 hours at 450°C under a pressure of about 3 atmospheres, gauge, then the temperature was gradually elevated to 470°C, at which temperature the material was further maintained for 2 hours. Upon completion of the coking operation, raw cokes of needle-shaped texture were obtained in a quantity of 53 kg together with 62 kg of distilled oil component.

The resulted raw cokes were calcined at a temperature of 1,300°C to produce calcined cokes of a true specific gravity of 2.15 and a bulk specific gravity of 1.13. These calcined cokes were used as an aggregate for manufacturing an electrode by a known method. The electrode showed the thermal expansion coefficient of $1.7 \times 10^{-6}$/°C.

EXAMPLE 2

A heavy fraction oil obtained from an ethylene cracker was subjected to flash distillation to remove low-boilers, whereby a tarry material having a boiling temperature of over about 350°C was obtained.

The tarry material thus obtained was charged in a coking drum in an amount of 120 kg. The coking drum was of 0.3 m inner diameter and 2.8 m in height. From the bottom of the coking drum, hydrocarbon vapor which had been heated to 370°C was blown into the tarry material thereby to heat the tarry material to 370°C. The hydrocarbon had a mean boiling temperature of 160°C and a mean molecular weight of 130. The temperature and flow rate of the hydrocarbon vapor were controlled so that the tarry material was maintained at a temperature of 350°C for 5.5 hours, the pressure being maintained at 2.8 to 3 atmospheres.

Then, the pressure in the coking drum was raised to 9 atmospheres, gauge, and the temperature in the coking drum was raised to 430°C, at which temperature the tarry material was maintained for 20 hours whereby the tarry material underwent coking. Hydrocarbon vapor was injected into the coking drum during the coking process, the flow rate thereof being 40 to 50 kg/hour and the temperature thereof being 410 to 450°C, the mean molecular weight of the hydrocarbon being 130, whereby the temperature within the coking drum was maintained at 430°C. The flow rate of the hydrocarbon vapor was calculated to be about 7.8 mm/sec. Then, the pressure was gradually lowered to atmospheric pressure and the temperature of the hydrocarbon vapor was raised to 500°C at which temperature the material within the coking drum was maintained for 3 hours, whereby the coking process was finished.

The coke thus obtained weighed 57 kg, and had an appearance inherent to needle-shaped cokes.

The bulk and the true density of the coke after calcination at 1,300°C were 1.20 and 2.17, respectively. 100 parts of the coke was kneaded with 35 parts of a coal pitch and processed to manufacture a test sample of an artificial graphite electrode by a generally employed method. The thermal expansion coefficient of the sample was determined at $1.5 \times 10^{-6}$/°C in the temperature range of 300° to 800°C. The same measurement was also conducted on another sample electrode in which a coke commercially available for electrode manufacturing ("Premium Cokes," a product of Great Lakes Carbon Co., U.S.A.) was employed in the manufacture thereof. The thermal expansion coefficient of this sample electrode was determined to be $2.05 \times 10^{-6}$/°C.

What is claimed is:

1. A process for producing high grade needle-shaped cokes which comprises:

A. charging a raw material oil selected from the group consisting of (a) residual oils resulting from distillation or solvent extraction of petroleum to separate light fractions therefrom, (b) heavy tars and pitches resulting from pyrolysis of petroleum oils, (c) heavy tars and pitches of *b* which have been subjected to thermal reforming, (d) coal tars and coal pitches and (e) mixtures of such raw materials which melt at a temperature below 250° to 450°C to a liquid state, into a coking drum, B. reforming the charged raw material oil in the coking drum by heating said oil as a liquid pool at a temperature of from 300° to 400°C under a pressure of from 2mmHg to 3 atmospheres for from 0.5 to 10 hours, C. coking the liquid pool reformed raw material oil by heating said oil in the coking drum at a temperature of from 400° to 500°C under a pressure higher than atmospheric pressure while blowing a non-oxidizing gas selected from the group consisting of vaporized hydrocarbon oil, hydrogen, nitrogen and steam heated at a temperature higher than that of the reformed raw material oil by at most 300°C into the bottom of the coking drum and through said liquid pool at a flow rate of from 5 to 50 millimeters/second, calculated on the basis of the flow velocity of the gas through the empty coking drum, until coking of the reformed raw material oil has been substantially completed, thereby simultaneously heating and agitating the reformed raw material oil within the coking drum to secure uniform heating of the reformed raw material oil, removal of excess heat generated in the coking drum and promotion of crystal orientation of the coke to be produced, and D. decoking the product thus produced, the entire process being carried out in the absence of, and without formation of, a fluidized bed.

2. A process as claimed in claim 1 in which said reforming is effected by heating said raw material oil by bubbling a heated non-oxidizing gas selected from the group consisting of hydrocarbon oil, hydrogen, nitrogen and steam into said oil.

3. A process as claimed in claim 1 in which said non-oxidizing gas is vaporized hydrocarbon oil.

4. A process as claimed in claim 2 in which said non-oxidizing gas is vaporized hydrocarbon oil.

5. A process as claimed in claim 1 in which said raw material oil is preheated before being charged into said coking drum.

6. A process as claimed in claim 5 in which said preheated raw material oil is subjected to fractionation to remove lower boiling hydrocarbon oil.

7. A process as claimed in claim 6 in which said lower boiling hydrocarbon oil is utilized as said non-oxidizing gas.

8. A process as claimed in claim 1 in which at least three coking drums are employed in parallel and the respective steps taking place in the coking drums are sequentially staggered, whereby continuous production of coke is realized.

* * * * *